US006082090A

United States Patent [19]

Wassenhoven et al.

[11] Patent Number: 6,082,090

[45] Date of Patent: Jul. 4, 2000

[54] METHOD FOR PRODUCING SPINNING BOX FRAMES FOR OPEN-END SPINNING DEVICES

[75] Inventors: Heinz-Georg Wassenhoven; Claus-Dieter Landolt; Jochen Dressen, all of Moenchengladbach; Dieter Haaken, Erkelenz, all of Germany

[73] Assignee: W. Schlafhorst AG & Co., Moenchengladbach, Germany

[21] Appl. No.: 09/065,747

[22] Filed: Apr. 24, 1998

[30] Foreign Application Priority Data

Apr. 26, 1997 [DE] Germany ..... 197 17 737

[51] Int. Cl.[7] ..... D01H 4/00

[52] U.S. Cl. ..... 57/406; 57/1 R

[58] Field of Search ..... 57/1 R, 400, 406, 57/407

[56] References Cited

U.S. PATENT DOCUMENTS

| | | | |
|---|---|---|---|
| 3,936,995 | 2/1976 | Laflaquiere et al. | 57/1 R |
| 3,977,168 | 8/1976 | Schewe | 57/406 |
| 3,990,219 | 11/1976 | Schewe | 57/1 R |
| 4,204,391 | 5/1980 | Clayton et al. | 57/1 R |
| 4,862,686 | 9/1989 | Stadele et al. | 57/1 R |
| 5,337,552 | 8/1994 | Schuller et al. | 57/406 |
| 5,431,006 | 7/1995 | Schuller et al. | 57/406 |
| 5,483,034 | 1/1996 | Havard et al. | 219/121.64 |

FOREIGN PATENT DOCUMENTS

| | | |
|---|---|---|
| 2 112913 | 10/1972 | Germany . |
| 25 55 059 C2 | 7/1984 | Germany . |
| 36 30 256 A1 | 3/1988 | Germany . |
| 32 47 411 C2 | 2/1994 | Germany . |

*Primary Examiner*—William Stryjewski
*Attorney, Agent, or Firm*—Kennedy Covington Lobdell & Hickman, LLP

[57] ABSTRACT

A method for producing a spinning box frame for an open-end spinning machine wherein lateral elements (2, 3) of a spinning box frame (1) are connected with interposed bracing elements (4, 5, 6) by means of a welding process which substantially prevents the occurrence of heat distortion tensions. The bracing elements (4, 5, 6) are joined by means of a laser welding process, preferably with a $CO_2$ laser, squarely on the interior wall (20) of the lateral elements (2, 3). The components (2 to 6) of the spinning box frame (1) are fixed in place in a welding device (26), which permits the exact positioning of the individual components during the laser welding process.

7 Claims, 4 Drawing Sheets

METHOD FOR PRODUCING SPINNING BOX FRAMES FOR OPEN-END SPINNING DEVICES

FIELD OF THE INVENTION

The present invention relates to a method for producing a spinning box frame for an open-end spinning device, and more particularly, to a method for producing a spinning box having lateral elements, which can be fastened to the machine base frame of the open-end spinning machine, and bracing elements disposed between the lateral elements.

BACKGROUND OF THE INVENTION

Spinning box frames for open-end spinning machines have been long known, for example in connection with rotor spinning machines, and have been described in various places of the literature. For example, an open-end spinning machine with open-end rotor spinning devices is known from German Patent Publication DE 32 47 411 C2, wherein the individual spinning box frames have each been assembled from several individual elements which are exactly connected with each other by means of screw connections and alignment pins. The spinning box frames essentially consist of two lateral elements, which can be fixed in place on the base frame of the machine, two upper bracing elements and a lower spacer. Prior to their assembly, the lateral elements as well as the bracing elements already have been formed with all necessary bores required for a functionally correct assembly of the spinning box frame, and for a correct installation and connection of the components of the spinning device.

However, it is disadvantageous in connection with spinning box frames manufactured in this way that the individual components must have a multitude of alignment bores, since a correctly aligned assembly of the parts can only be assured by means of such alignment bore-and-pin arrangements. It has furthermore been shown that over extended periods it is not possible to assure a sufficient rigidity of the spinning box frame by means of screw connections.

For this reason, some time ago spinning box frames began to be made by connecting the lateral elements and the bracing elements of the spinning box frames by arc welding. However, since in the course of arc welding the workpieces to be welded together are heated relatively strongly and over a large area, it is not possible with this joining method to prevent warping of these components because of heat expansion. With this known joining method, it is therefore necessary to align the welded spinning box frames following cooling. Thus, accurately aligned functional bores can only be cut after the alignment process.

SUMMARY OF THE INVENTION

Based on the above mentioned prior art, it is therefore an object of the invention to develop a method of joining the structural elements of spinning box frames which allows the cost-efficient manufacture of rigid spinning box frames.

In accordance with the invention, this object is attained by means of a method for producing a spinning box frame for an open-end spinning device, having a pair of lateral elements which can be fastened to the machine base frame of the open-end spinning machine and bracing elements disposed transversely between the lateral elements. According to the present invention, the method basically comprises initially preforming the lateral elements and the bracing elements, including preforming the lateral elements with all functional bores to be required for fastening to the machine base frame of the open-end spinning machine. The lateral elements and the bracing elements are connected with the bracing elements extending transversely between the lateral elements to define a spacing between the lateral elements by forming welds between the lateral elements and the bracing elements without producing heat distortion tensions in the lateral elements and the bracing elements such that subsequent alignment of the lateral elements and the bracing elements is unnecessary.

In particular, the method in accordance with the present invention has the advantage that the lateral elements as well as the bracing elements can be formed in their final shape, including formation of all functional bores, prior to the joining process, since there is no concern for heat distortion of the components in the course of the joining process.

Advantageously, the method is performed by employing a laser welding method, since with this joining method it is possible to exactly meter the energy used and it can be very exactly localized by means of focusing the laser beam. Because of the relatively small, narrowly defined heat source of high energy, a heating effect over a large surface of the workpieces, such as is unavoidable in connection with conventional arc welding, does not occur. Thus, prior to the joining process, all bores, including the functional bores which have presented problems heretofore in conventional methods, can be cut into the lateral elements and the bracing elements. During the joining process, some of the functional bores can be used for the exact positioning of the components.

It is also particularly advantageous if the bracing elements are set squarely on the interior of the wall of the lateral elements, and are welded by means of a laser beam directed to the exterior of the wall of the lateral elements. The placement of the laser beam to the exterior of the wall of the lateral elements allows the problem-free handling of the laser welding device, so that the automatic laser welding device, or its positioning device, can be of a relatively simple and uncomplicated construction.

Preferably, by use of laser welding, the bracing elements are connected by means of comparatively long weld seams, which preferably extend over the entire connecting surface of the bracing elements with the lateral elements and thereby achieves a particularly great rigidity of the spinning box frame. In contrast, it is recommended in the conventional arc welding process that only relatively short weld seams are formed on account of the relatively strong heat distortion which is produced. In addition, laser welding has the advantage that, although this joining method leads to a narrow seam geometry, the weld seams have a large depth-to-width ratio.

It is further preferred that the bracing elements as well as the lateral elements are fixed in place in accurate alignment in a special welding device during the laser welding process. This accurately aligned placement of the components results in the welded spinning box frames being always identical, even in mass production, which enables the spinning boxes when needed to be exchanged without problems.

In a preferred embodiment, the welding device has plug-in gauges which are inserted into corresponding functional bores of the lateral elements to allow the exact alignment of the lateral elements of the spinning box frame during the laser welding process in a simple manner.

It is advantageous for the laser welding to be performed by means of a $CO_2$ laser which achieves superior results, particularly in connection with low carbon and low sulfur materials, because finishing is minimal due to the occurrence of little sputtering as well as the narrow and even weld seam surfaces. Such a $CO_2$ laser is furthermore distinguished by particularly advantageous gas costs.

Further details of the invention will be understood from an exemplary embodiment described below with reference to the accompanying drawings.

DETAILED DESCRIPTION OF THE PREFERRED EMBODIMENT

Figure 1:
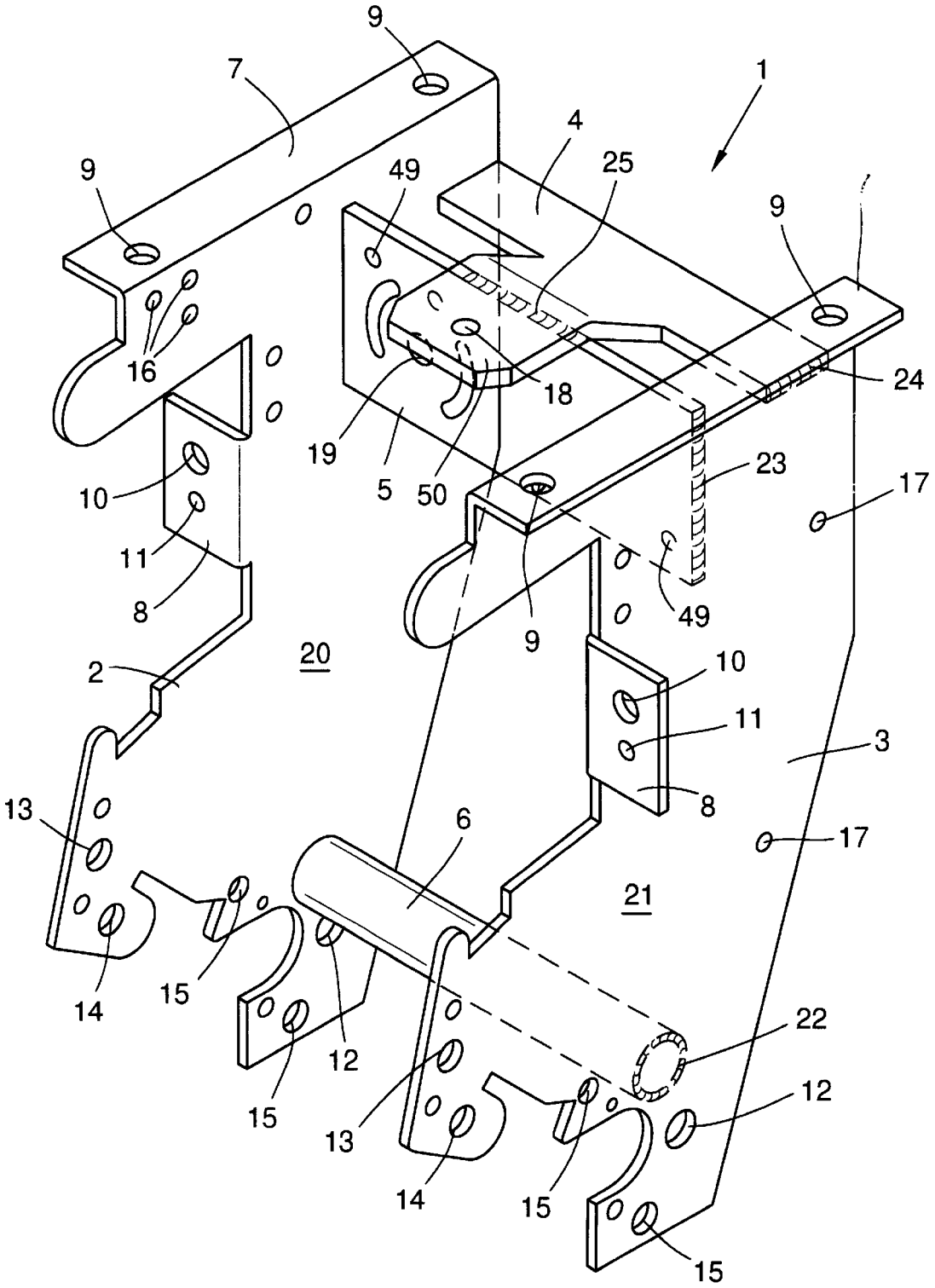
FIG. 1 is a top perspective view of a spinning box frame joined by means of a laser welding process in accordance with a preferred embodiment of the present invention.

Referring now to the accompanying drawings and initially to FIG. 1, a spinning box frame 1 as joined by means of a laser welding method according to the present invention is shown in perspective view. As is customary, the spinning box frame comprises two lateral plate-like elements 2, 3, spaced apart in opposed facing relation and bracing elements 4, 5, 6, which extend transversely between the lateral elements 2, 3.

At their respective ends, the lateral elements 2, 3 have angle flanges 7. The spinning box frame 1 can be fastened on the base frame (not represented) of an open-end spinning machine via these angle flanges 7, and particularly via bores 9 formed in these angle pieces 7. Additionally, each of the lateral elements 2, 3 is provided with an angle bracket 8 each formed with bores 10 and 11, in which a support bracket (not shown) for a supporting ring bearing can be fastened. Such supporting ring bearings in which a spinning rotor revolves at high rpm are illustrated and relatively extensively described, for example, in German Patent Publication DE 32 47 411 C2.

The lateral elements 2, 3 have a plurality of further bores 12–17, in which the various components of the open-end spinning device can be fastened, such as the bearing for the driveshaft of the sliver draw-in cylinder, and the like.

The bracing elements 4, 5 inserted between the lateral elements 2, 3 also have various fastening bores 18, 19, etc. For example, a pressure roller is fixed in the bore 19 of the bracing element 5 which in a known manner maintains a tangential belt in connection with the shaft of the spinning rotor. The fastening bore 18 in the bracing element 4 can for example be used for fixing a rotor housing (not represented) in place.

The lateral elements 2, 3 and the bracing elements 4, 5, 6 are connected with each other by means of laser weld seams 22, 23, 24, 25. Here, the laser weld seams 22, 23, 24 connect the bracing elements 4, 5, 6, with these lateral elements 2, 3, with the bracing elements set squarely on the inner walls 20 of the lateral elements 2, 3, while the bracing elements 4 and 5 are additionally connected with each other by means of the laser weld seam 25.

Figure 2:
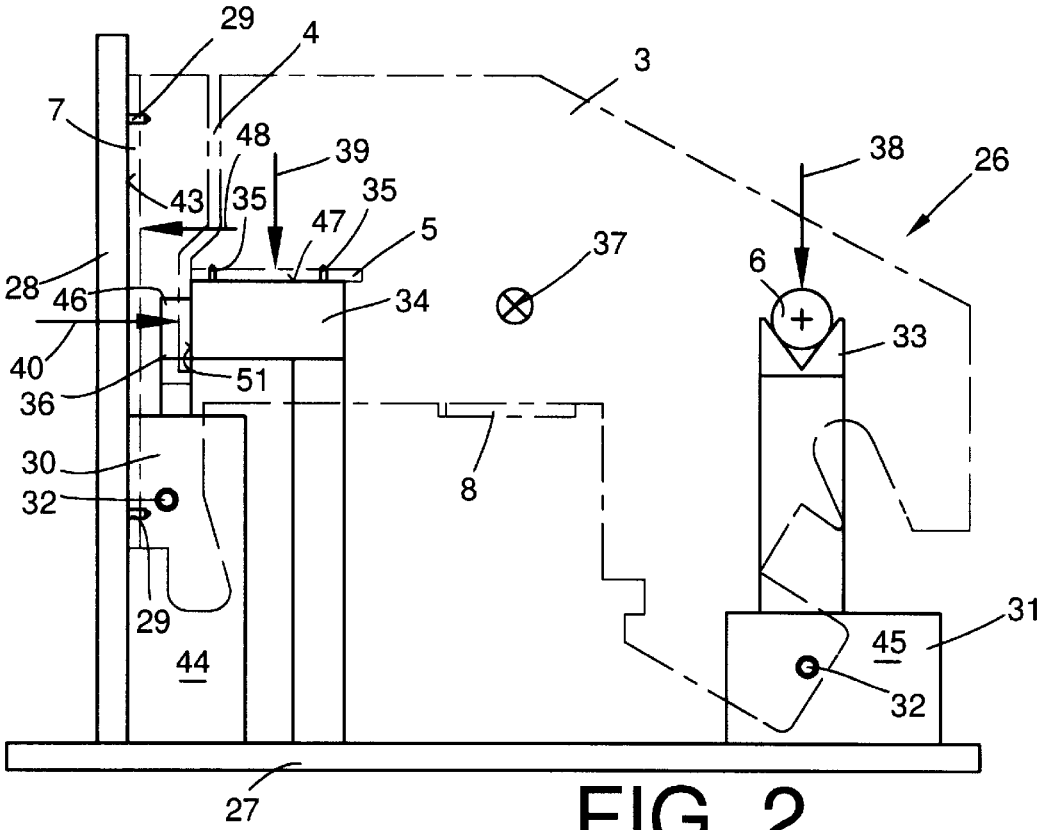
FIG. 2 is a side elevational view of a welding device for performing the method of the present invention, wherein a spinning box frame being formed is indicated by dash-dotted lines.
Figure 3:
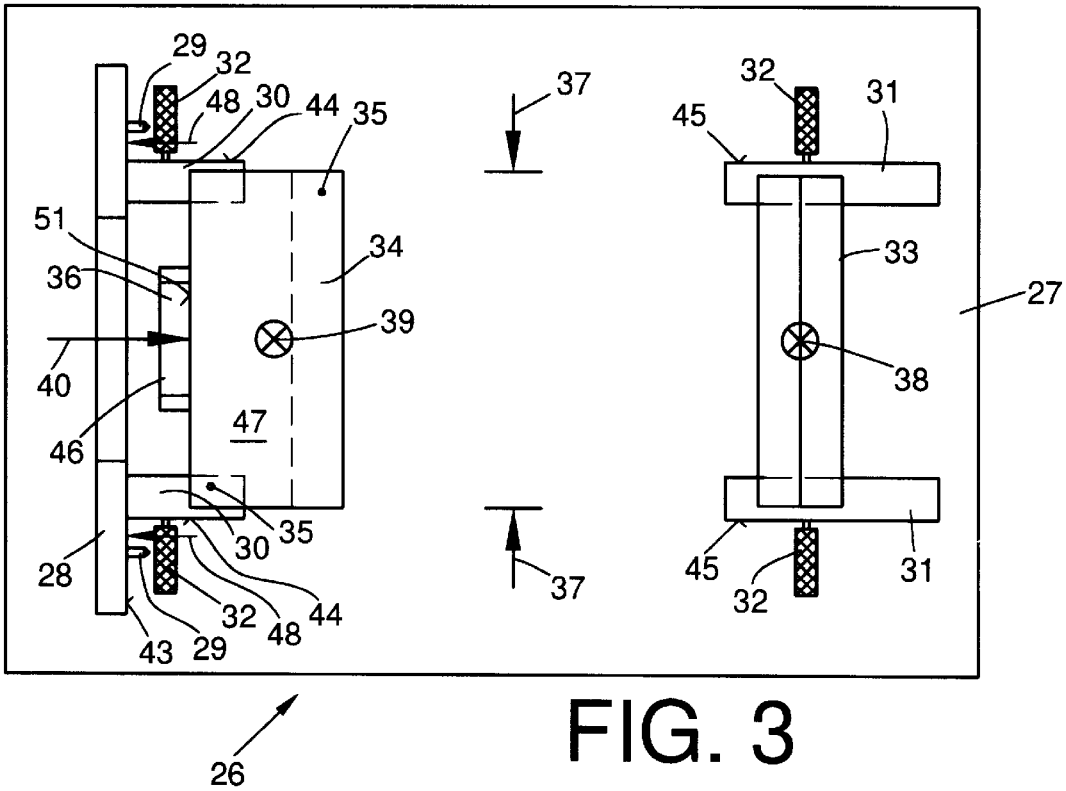
FIG. 3 is a top plan view of the welding device in accordance with FIG. 2, and FIGS. 4 to 8 are additional top plan views of the welding device similar to FIG. 3, showing the functional sequence when equipping the welding device.

During the laser welding process the individual components of the spinning box frame 1 are disposed in accurate alignment with one another in a welding device 26 shown in FIGS. 2 and 3. Here, the welding device 26 has a base plate 27, on which various abutment elements for positioning, as well as bracing devices for fixing the components in place, are arranged. Preferably, the abutment elements, or at least their contact surfaces, are made wear-resistant, for example by hardening.

As seen in FIGS. 2 and 3, a relatively tall upstanding abutment element 28 is positioned at one end of the base plate 27 (i.e. the left side of the base plate 27 as viewed in FIGS. 2 and 3) and thereby presents vertically extending contact faces 43. Positioning pins 29 project from these contact faces 43 and correspond to appropriate bores in the lateral elements 2, 3 in the assembled state.

Two upstanding lateral abutment elements 30 are arranged on the base plate 27 forwardly (i.e. rightwardly as viewed in FIGS. 2 and 3) of the abutment element 28, in opposed spaced facing relation to one another. The abutment elements 30 have respective contact faces 44 which extend vertically, but orthogonally in respect to the contact faces 43. The contact faces 44 each have one respective alignment bore, in which a plug-in gauge 32 can be positioned.

A table-like support 34 is arranged above the abutment elements 30 and presents a horizontally extending support surface 47 from which positioning pins 35 project upwardly. In addition, a guide 46 is disposed between the abutment element 28 and the table-like support 34 and is embodied in a V-shape with a vertical contact face 51.

Additional abutment elements are provided on the opposite (right) end of the base plate 27. Specifically, two upstanding lateral abutment elements 31 are disposed in opposed spaced facing relation to one another and present respective vertical contact faces 45 which constitute extensions of the contact faces 44 of the abutment elements 30. A respective alignment bore for a plug-in gauge 32 is also provided in each of the contact faces 45.

These so-called plug-in gauges 32 are positioning devices which preferably have a hardened guide body and a pin-like neck ground to exact size by which the plug-in gauges 32 can be threaded through appropriate functional bores of the lateral elements 2, 3 and into a corresponding alignment bore in the contact faces 44, 45 of the abutment elements 30, 31, whereby the plug-in gauges 32 align the lateral elements 2, 3 exactly at the contact faces 44, 45 of the abutment elements 30 and/or 31.

For aligning a rod-shaped bracing element 6, a abutment element 33, which for example is prismatic in shape (see FIG. 2), is disposed slightly above the abutment elements 31 approximately at the height of the table-like support 34.

Respective bracing devices, indicated only representatively by arrows 48, 37, 38, 39, 40, are arranged in the area of the previously described abutment elements 28, 30, 31, 33, 34 and 36. These bracing devices allow the secure fixation in place of the components when disposed against the abutment elements in a positionally exact manner, for the laser welding process.

Figure 4:
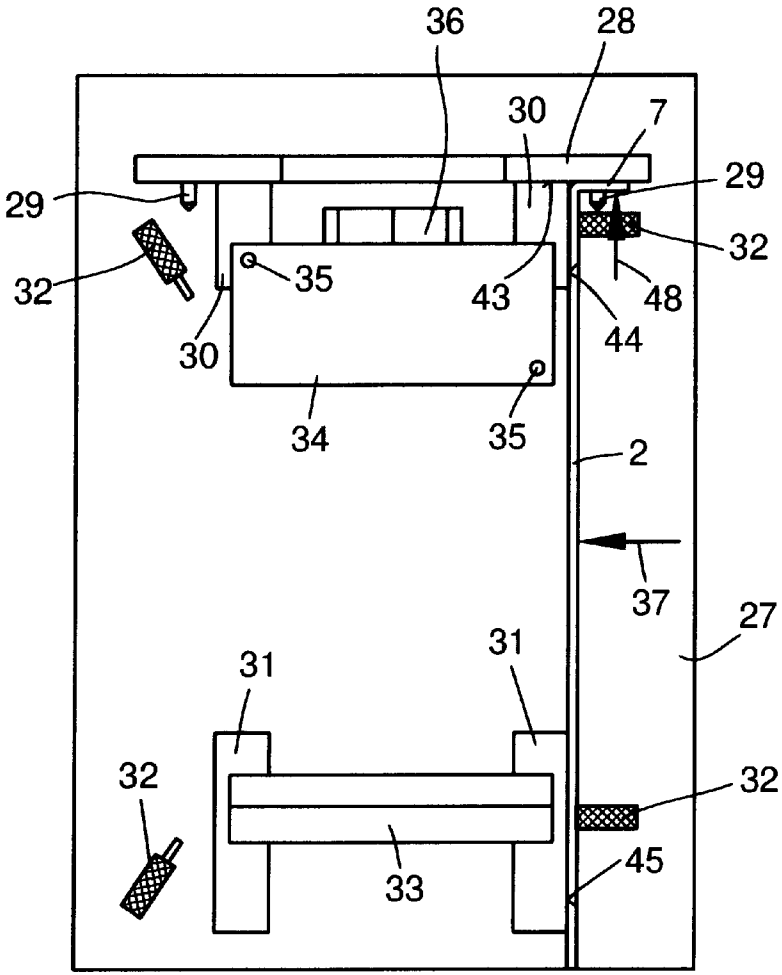

The sequence of operation in utilizing the welding device to produce a spinning box frame according to the method of the present invention may thus be understood with reference to FIGS. 4–8. As represented in FIG. 4, one lateral element 2 is initially aligned against the abutment elements 28, 30, 31, specifically by pushing the bores 9 in the angle piece 7 of the lateral element 2 onto the positioning pins 29 on the abutment surface 43, and then threading the plug-in gauges 32 through the functional bores 12 and 16 in the lateral element 2 into corresponding alignment bores in the abutment elements 30 and 31. In this manner, the lateral element 2 is exactly aligned and can be fixed in place by the bracing means 37 and 48.

Figure 5:
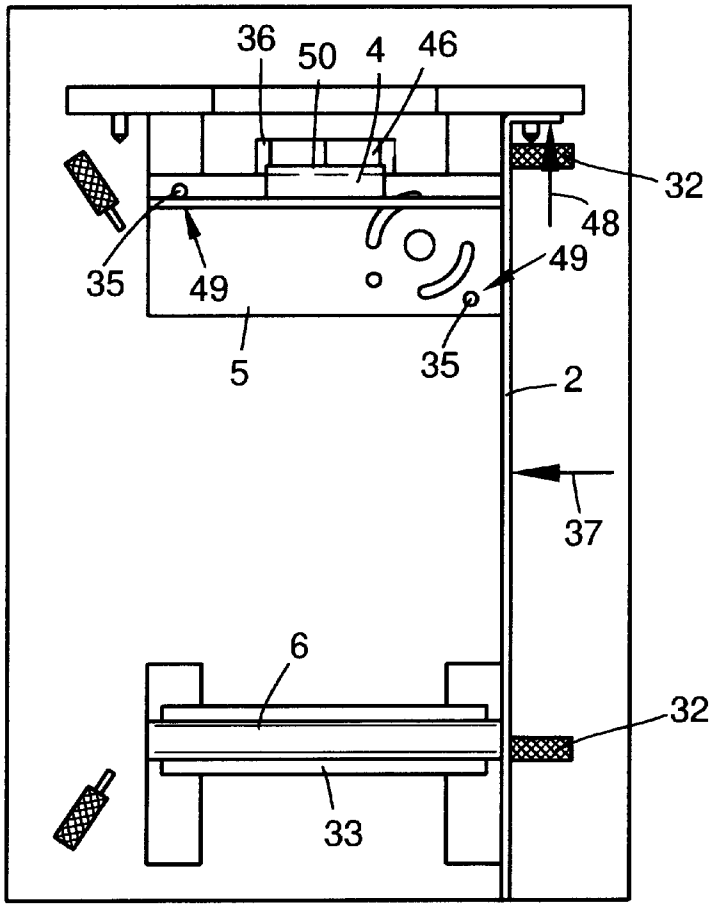

In the next step represented in FIG. 5, the bracing elements 4, 5, 6 are inserted. Specifically, the bracing element 6, preferably designed as a round rod, is inserted into the prismatic abutment element 33. The bracing element 5, which among others also has bores 49, is positioned with these bores 49 pushed over the positioning pins 35 on the support 34 and is in this manner aligned on the table-like support surface 47. Finally, the tongue-like neck 50 of the bracing element 4 is inserted into a guide 46 of the abutment element 36 and in this position partially extends over the bracing element 5.

Figure 7:
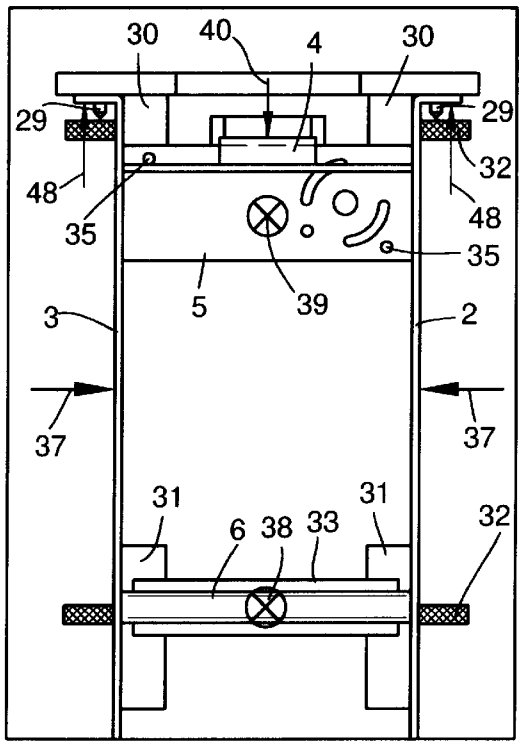
Figure 6:
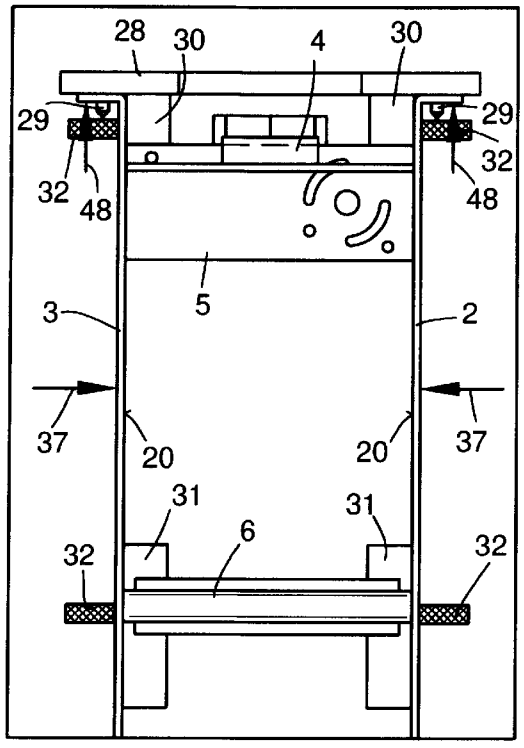

As indicated in FIG. 6, the lateral element 3 is subsequently inserted into the welding device 26. The process steps for positioning and securement of the lateral element 3 correspond to the process steps as already described above in connection with the lateral element 2. As can be seen from FIG. 6, once the components of the spinning box frame have been thusly positioned, the lateral joint edges of the bracing elements 4, 5, 6 rest squarely against the interior walls 20 of the lateral elements 2 and 3. When bracing the lateral element 3 by means of the bracing means 37 and 48, the bracing elements 4, 5, 6 are automatically aligned in respect to the longitudinal center axis of the welding device to the extent still required, and subsequently the bracing elements 4, 5, 6 can be fixed in place on the abutment elements 33, 34, 36 by means of the appropriate bracing devices 38, 39, 40, as represented in FIG. 7, as final preparation for the laser welding process.

Figure 8:
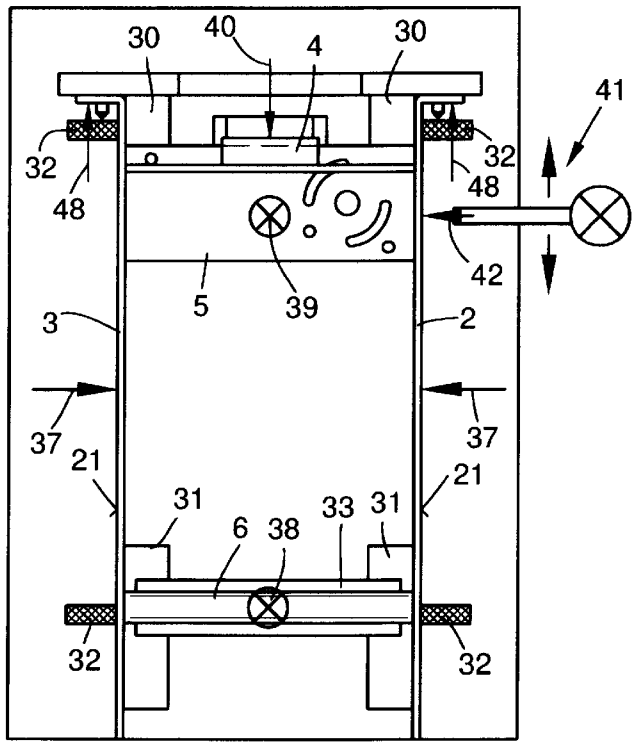

Subsequently the spinning box frame elements as thusly fixed in place in the welding device 26 are joined, as indicated in FIG. 8, by means of a laser welding robot or an automatic laser welding device 41, which is guided in an appropriate positioning device (not represented). In this case, the laser beam 42 of the automatic laser welding device 41 is directed to the exterior wall 21 of the lateral elements 2, 3, or respectively to the exterior wall of the bracing element 4.

As already indicated initially above, the laser beam 21 has a large energy potential and can be both very exactly metered and very exactly localized, so that the bracing elements 4, 5, 6 can be sequentially welded together with the lateral elements 2, 3 by means of the automatic laser welding device 41 from the direction of the exterior wall 21 of the lateral elements 2, 3. Because of the very localized heating, no heat-related distortion tensions occur. Since the bracing elements 4, 5, 6 are not only connected with the lateral elements 2, 3, but also the bracing element 4, 5 are joined to each other by means of the automatic laser welding device 41, a very rigid spinning box frame is obtained, which already has all functional bores which are very accurately aligned with one another without requiring formation, adjustment or alignment subsequent to the welding process.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for producing a spinning box frame for an open-end spinning device, having a pair of lateral elements which can be fastened to the machine base frame of the open-end spinning machine and bracing elements disposed transversely between the lateral elements, the method comprising:

initially preforming the lateral elements and the bracing elements, including preforming the lateral elements with all functional bores to be required for fastening to the machine base frame of the open-end spinning machine, and connecting the lateral elements and the bracing elements with the bracing elements extending transversely between the lateral elements to define a spacing between the lateral elements, the connecting comprising laser welding of welds between the lateral elements and the bracing elements without producing heat distortion tensions in the lateral elements and the bracing elements such that subsequent alignment of the lateral elements and the bracing elements is unnecessary;

wherein, during the laser welding, the bracing elements rest squarely against respective interior wall surfaces of the lateral elements and the laser welding comprises directing a laser beam onto respective exterior wall surfaces of the lateral elements.

2. The method in accordance with claim 1, wherein the laser welding comprises connecting the bracing elements to the lateral elements by continuous laser weld seams and connecting the bracing elements to each other by a laser weld seam.

3. The method in accordance with claim 1, wherein the laser welding comprises fixing the bracing elements and the lateral elements in place in exact alignment in a welding device.

4. The method in accordance with claim 3, wherein fixing of the bracing elements and the lateral elements in the welding device comprises inserting plug-in gauges into the functional bores of the lateral elements to accomplish exact alignment of the lateral elements in the welding device.

5. The method in accordance with claim 1, wherein the laser welding comprises providing the welding device with abutment elements and bracing devices for positioning the bracing elements in the welding device.

6. A method for producing a spinning box frame for an open-end spinning device, having a pair of lateral elements which can be fastened to the machine base frame of the open-end spinning machine and bracing elements disposed transversely between the lateral elements, the method comprising:

initially preforming the lateral elements and the bracing elements, including preforming the lateral elements with all functional bores to be required for fastening to the machine base frame of the open-end spinning machine, and connecting the lateral elements and the bracing elements with the bracing elements extending transversely between the lateral elements to define a spacing between the lateral elements, the connecting comprising laser welding of welds between the lateral elements and the bracing elements without producing heat distortion tensions in the lateral elements and the bracing elements such that subsequent alignment of the lateral elements and the bracing elements is unnecessary;

wherein the laser welding comprises connecting the bracing elements to the lateral elements by continuous laser weld seams and connecting the bracing elements to each other by a laser weld seam.

7. A method for producing a spinning box frame for an open-end spinning device, having a pair of lateral elements which can be fastened to the machine base frame of the open-end spinning machine and bracing elements disposed transversely between the lateral elements, the method comprising:

initially preforming the lateral elements and the bracing elements, including preforming the lateral elements with all functional bores to be required for fastening to the machine base frame of the open-end spinning machine, and connecting the lateral elements and the bracing elements with the bracing elements extending transversely between the lateral elements to define a spacing between the lateral elements, the connecting comprising laser welding of welds between the lateral elements and the bracing elements without producing heat distortion tensions in the lateral elements and the bracing elements such that subsequent alignment of the lateral elements and the bracing elements is unnecessary;

wherein the laser welding comprises providing a welding device with abutment elements and bracing devices for positioning the bracing elements in the welding device.

* * * * *